United States Patent [19]

McCormick

[11] 4,115,959

[45] Sep. 26, 1978

[54] METHOD FOR INCREASING THE LIFE OF SILICON CARBIDE GRINDING WHEELS

[75] Inventor: Harold E. McCormick, Ballwin, Mo.

[73] Assignee: Ramsey Corporation, St. Louis, Mo.

[21] Appl. No.: 763,831

[22] Filed: Jan. 31, 1977

[51] Int. Cl.[2] ..... B24D 3/24

[52] U.S. Cl. ..... 51/295; 51/307; 51/309 R; 277/235 A; 427/423

[58] Field of Search ..... 277/235, 231; 51/307, 51/309, 295; 427/423

[56] References Cited

U.S. PATENT DOCUMENTS

| | | | |
|---|---|---|---|
| 2,984,555 | 5/1961 | Curtis | 51/309 |
| 3,121,643 | 2/1964 | Eisenberg | 428/334 |
| 3,157,529 | 11/1964 | Sliney | 106/63 |
| 3,295,941 | 1/1967 | Spellman | 51/309 |
| 3,697,091 | 10/1972 | Prasse et al. | 277/235 |
| 3,794,334 | 2/1974 | Prasse et al. | 277/235 |

*Primary Examiner*—Donald J. Arnold

[57] ABSTRACT

The life of silicon carbide grinding wheels is increased when operating against plasma applied coatings of mixed oxides of refractory metals on a cast iron substrate. The invention contemplates the inclusion of certain metal fluorides in the refractory metal oxide powder prior to plasma application, coating by plasma spray, and then grinding with a silicon carbide grinding wheel with reduction in or elimination of in-cycle dressing of the wheel.

15 Claims, 7 Drawing Figures

Fig. 1
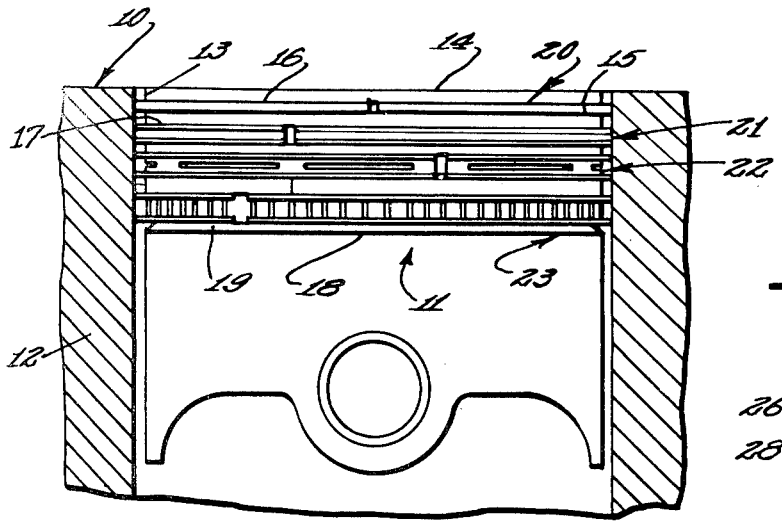
Fig. 2
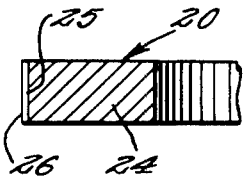
Fig. 3
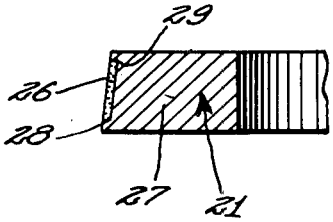
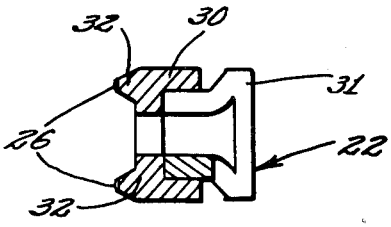
Fig. 4
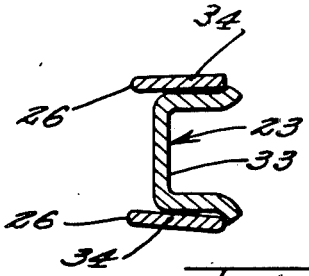
Fig. 5
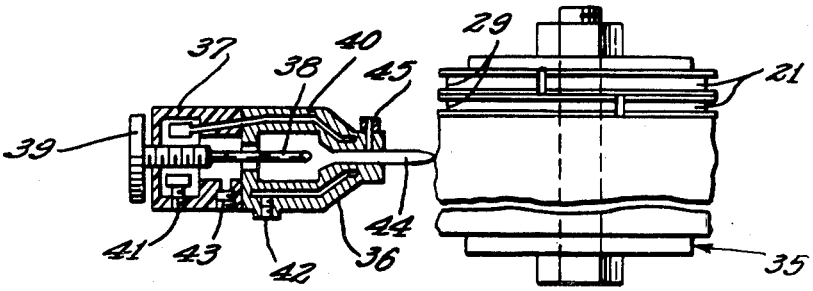
Fig. 6

METHOD FOR INCREASING THE LIFE OF SILICON CARBIDE GRINDING WHEELS

BACKGROUND OF THE INVENTION AND PRIOR ART

U.S. Pat. No. 3,697,091 relates to piston rings which have been plasma spray coated with a titanium dioxide-aluminum oxide coating wherein the coating contains from 10 to 25% by weight of titanium dioxide and the balance, aluminum oxide. U.S. Pat. No. 3,794,334 relates to piston rings which have been coated with a zirconium oxide coating. These coatings are extremely hard, and are particularly useful as piston ring facing coatings.

However, there is a production difficulty encountered in the manufacture of piston rings with this type of coating. The piston rings are normally coated by plasma spray technique, as clearly pointed out in the aforesaid U.S. patents, by mounting a number of cast iron piston ring blanks on a mandrel, and applying by plasma spray technique, a titanium dioxide-aluminum oxide or zirconium oxide coating thereon. The thickness of the coating so applied is generally in the range of between about twenty thousandths of an inch and thirty thousandths of an inch. Approximately one-half of the applied coating is removed by grinding in order to smooth and true the surface for use as a piston ring.

To effect the grinding operation, silicon carbide grinding wheels are used. One manufacturer's designation, namely Bay State Abrasive Products Company, of a typical silicon carbide grinding wheel used for this operation is IC-802-J8-V32. Because of the extreme hardness of the coatings, it has been found that the silicon carbide grinding wheel must be "in-cycle dressed" as many as five times in the course of removing such refractory metal oxide coatings to the extent of about one-half the applied depth in the finishing of a standard 4 inch piston ring.

Dressing is accomplished with a diamond dressing tool in a known manner, and each such dressing removes from the diameter of the wheel approximately 0.002 inch. The large diameter silicon carbide grinding wheels used in finishing piston rings for internal combustion engines are quite expensive, and consequently, the minimizing of dressing during the grinding cycle gives rise to a number of cost saving advantages. In the first place, since dressing necessitates removal of the surface of the wheel to present a new grinding surface, there is cost involved not only in terms of the amount of grinding wheel which is lost but also the production time required to effect dressing. Moreover, as the wheel wears, the grinding characteristics of the wheel change often necessitating adjustment in the grinding parameters.

The present invention greatly alleviates the problems in wheel dressing and the consequent loss of grinding wheel surface.

The benefits of the present invention are achieved by incorporating into the plasma powder mixture of refractory metal oxide prior to plasma application thereof a minor amount, e.g., 10 - 15% by weight, of a metal fluoride. Metal fluoride materials, such as calcium fluoride, are known and used as dry lubricants in certain ceramic oxide coatings.

Various prior art discloses that metal fluoride materials such as calcium fluoride have been used in ceramic oxide coatings. Typical of such prior art are U.S. Pat. Nos. 3,157,529, 3,121,643, and 2,869,227. Further are relating in such mixtures is the article by Hillert (Acta. Chem. Scand. 20 (1), 251-3 (1966) Eng.) and a paper by Gardos, ASLE Pre-print No. 74, LC 2C-2 entitled "Some Topographical and Tribological Characteristics of A $CaF_2/BaF_2$ Eutectic Containing Porous Nichrome Alloy Self-Lubricating Composite" presented at the ASLE/ASME Lubrication Conference held in Montreal, Canada, Oct. 8–10, 1974. A paper presented at the same conference held in Atlanta, GA, Oct. 16–18, 1973 by Moore et al. entitled "The Friction And Wear Characteristics Of Plasma-Sprayed $NiO-CaF_2$ In Rubbing Contact With A Ceramic Matrix" is also illustrative of related art.

None of the above noted prior art documents discloses the substantial improvement in manufacturing due to the material composition. Further, none of the art discloses the specific composition disclosed herein and none of the art is related to piston ring manufacture other than U.S. Pat. No. 3,697,091 which does not disclose the composition disclosed herein. In fact, some of the art noted discloses processes which are entirely unsuited for piston ring manufacture.

BRIEF STATEMENT OF THE INVENTION

Broadly stated, the present invention is in a method of manufacturing an article with a bearing surface. The surface is formed by plasma spray coating a metallic substrate with a ceramic oxide composition containing at least one alkaline earth metal fluoride, cooling the coated article, and then grinding the coating with a silicon carbide grinding wheel to smooth and finish the bearing surface.

The present invention provides for increasing the life of silicon carbide grinding wheels when operating against a plasma applied coating of mixed oxides of titanium and aluminum derived from a powder mixture of said oxides and applied on a cast iron substrate to a thickness up to about 0.030 inch. The process comprises the steps of incorporating from 10 to 15% by weight of a metal fluoride into the mixed oxide powder prior to plasma application to the substrate. The metal fluoride is selected from the group consisting of alkaline earth metal fluorides and mixtures of alkaline earth metal fluorides. More particularly, the process then contemplates grinding off up to about one-half the thicness of the oxide coating with a silicion carbide grinding wheel to smooth and true the bearing surface thereby greatly reducing or eliminating entirely in-cycle dressing of the wheel. The present invention is particularly useful in the manufacture of piston rings.

By utilizing the present method, substantial savings in the cost of silicon carbide grinding wheels is experienced with only very minor sacrifice in the wear characteristics of piston rings coated with mixed oxides of titanium and aluminum and containing from 10 to 15% by weight of other materials such as calcium fluoride, for example. Prior to this time, with coatings consisting only of the oxides of titanium and aluminum, the grinding operation utilizing a silicon carbide grinding wheel has required up to five in-cycle dressings of the wheel in the course of removing the plasma applied refractory metal oxide coating to the desired depth and finish for piston rings. The incorporation of the metal fluoride has resulted in the virtual elimination of the in-cycle dressing of the wheel when operating against plasma applied coating of such mixed oxides.

BRIEF DESCRIPTION OF THE DRAWINGS

The invention may be better understood by having reference to the annexed drawings herein:

FIG. 1 is a side elevational view, with parts in cross section, of an engine piston ring cylinder assembly wherein the piston has ring grooves equipped with compression and oil control rings, each having a bearing face engaging the cylinder wall, which bearing face is composed of an insitu formed plasma jet applied iron extended molybdenum alloy according to this invention.

FIG. 2 is an enlarged fragmentary cross sectional view of the top compression ring of FIG. 1.

FIG. 3 is a view similar to FIG. 2 but illustrating the second compression ring in the piston of FIG. 1.

FIG. 4 is a view similar to FIG. 2, but illustrating the oil control ring in the third ring groove of the piston of FIG. 1.

FIG. 5 is a view similar to FIG. 2, but illustrating the oil control ring in the fourth ring groove of the piston of FIG. 1.

FIG. 6 is a diagrammatic cross sectional view of a plasma flame spray gun typically used to coat a cast iron base material according to the method of the present invention.

DETAILED DESCRIPTION OF THE DRAWINGS

Figure 7:
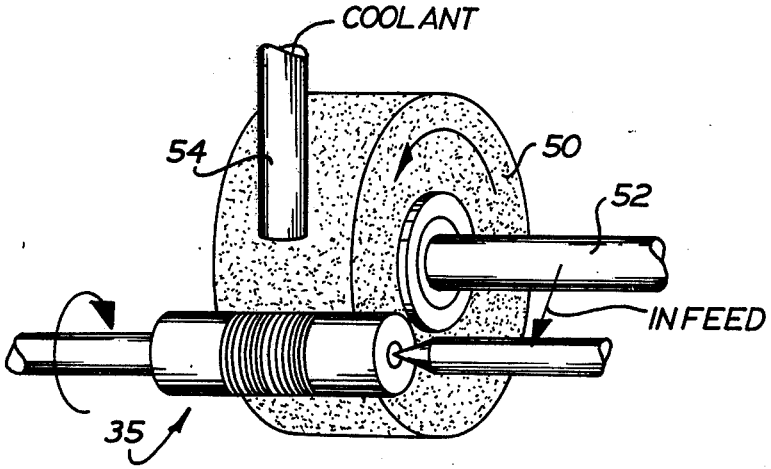
FIG. 7 is a diagrammatic representation of an on-center plunge-type grinder working against a mandrel of plasma spray coated piston rings in accordance with the present invention.

Referring now more specifically to FIG. 1, the piston and cylinder assembly 10 of FIG. 1 illustrates generally a conventional four-ring groove internal combustion engine piston operating in an engine cylinder. The assembly 10 includes a piston 11 and an engine cylinder 12 with a bore 13 receiving the piston 11. The piston 11 has a head 14 with the ring band 15 having four peripheral ring grooves 16, 17, 18 and 19 therearound. The top ring groove 16 has a split solid cast iron compression or fire piston ring 20 therein. The second ring groove 17 has a split solid second compression ring 21 somewhat whiter than the ring 20. The third ring groove 18 carries a two piece oil control ring assembly 22. The fourth or bottom ring groove 19 carries a three piece oil control ring assembly 23.

As shown in FIG. 2, the top compression or fire ring 20 has a main body 24 composed of cast iron, preferably nodular gray iron, with a carbon content of about 3.5% by weight. The outer periphery 25 of this ring is covered with a plasma jet applied alloy matrix coating 26 of the present invention.

As shown in FIG. 3, the second compression ring 21 has a main body 27 composed of the same type of cast iron as the body 24 of the ring 20. The outer periphery 28 of the body 27 is inclined upwardly and inwardly from the bottom edge of the ring and a peripheral groove 29 is formed around this inclined periphery. The groove 29 is filled with the alloy matrix 26.

As shown in FIG. 4, the oil control ring assembly 22 in the third ring groove 18 is composed of a one piece flexible channel ring 30 and a sheet metal expander ring 31, having legs extending into the channel for expanding the ring 30. The ring and the expander are more fully described in Mayhew et al. U.S. Pat. No. 3,281,156.

The one piece oil control ring 30 has a pair of axially spaced radially projecting beads 32. The peripheries of these beads 32 are coated with the coating 26.

In FIG. 5, the oil control ring assembly 23 includes a resilient spacer-expander ring 33 supporting an expanding split thin rail ring 34. The assembly 33 is of the type disclosed in the Marion U.S. Pat. No. 2,817,564. The outer peripheries of the oil rings 34 are coated with the alloy matrix coating 26 according to this invention.

From the above description, it will be understood that the bearing faces of each of the compression and oil control rings 20, 21, 22 and 23 are coated with the coating 26 in accordance with the present invention. The thus coated bearing faces 26 ride on and sealingly engage the wall of the bore 13 of the engine cylinder 12. The piston rings 20, 21, 22 and 23 are compressed in the bore 13 so as to expand tightly against the bore wall and maintain a good sealing, sliding engagement therewith.

As shown in FIG. 6, the coating or face 26 is applied on the rings as for example, on the groove rings 21, by stacking a plurality of the rings on an arbor 35 with the rings compressed so that their split ends will be nearly in abutment. The arbor clamping the stack of rings in their closed, contracted position, may be mounted in the lathe and the peripheries of the rings machined to form the grooves 29 therearound. The outer peripheries of the rings 21 on the arbor are then coated with the oxide matrix 26 from a plasma jet spray gun 36. The gun 36 includes an insulated casing such as nylon 37, from which projects a rear electrode 38, the projection of which is adjustably controlled by a screw knob 39. The front face of the casing receives a front electrode 40. The casing 37 and the electrode 40 are hollow and water jacketed so that the coolant may be circulated therethrough from an inlet 41 to an outlet 42. Plasma jet gas of conventional composition is fed through an inlet 43 into the chamber provided by the casing 37, and the electrode 40 to flow around the electrode 38.

The front end of the electrode 40 provides a nozzle outlet 44 for the plasma flame and the ingredients to form the oxide coating 26 are fed to this nozzle through a powder inlet 45, just in advance of the discharge outlet of the nozzle.

A plasma composed of ionized gas is produced by passing the plasma gas from the inlet 43 through an electric arc established between the electrodes 38 and 40. This plasma gas is non-oxidizing and is composed of nitrogen or argon in combination with hydrogen. The plasma flame exiting from the nozzle 44 draws the coating-forming powder therewith by aspiration and subjects the powder ingredients to such high temperatures as to cause them to fuse together. The spray powder is usually suspended in a carrier gas. The jet stream carries the material into the bottom of the groove 29 of each piston ring to fill the groove.

The preferred powder fed to the powder inlet 45 of the gun 36 is composed in accordance with Example II below.

FIG. 7 shows in diagrammatic form an on-center silicon carbide grinding wheel operating against a mandrel of plasma spray coated piston rings of the type shown in FIG. 2. The grinding wheel 50 is driven by conventional means in a counterclockwise direction shown by the arrow in FIG. 7, and is mounted upon an axle 52 which is movable at predetermined rates toward and away from the madrel 35. Mandrel 35 is driven by conventional means in a counterclockwise direction as shown by the arrow in FIG. 7 relative to the grinding wheel 50 and remains on its axis during the grinding operation. Coolant is supplied through a suitable nozzle 54 in a known manner.

Reference may be had to the aforementioned patent to Prasse, U.S. Pat. No. 3,697,091 for the details of coating compositions of titanium dioxide and aluminum oxide, and the spray parameters by which the oxide coatings of the present invention including the metal fluoride may be sprayed onto a mandrel 35 containing 20 piston ring blanks by the plasma spray technique. The plasma application of the refractory metal oxides are the same in the present method as they are for the application of the refractory metal oxides without the added metal fluoride component.

A typical set of spray parameters useful in applying ceramic oxide coatings to piston compression rings is as follows:

Number of Guns: 1
Type of Plasma Spray Gun: Metco 3MB
Gun to Work Distance: 4.5 inches
Angle of Gun To Axis of Work: 45°
Amperage, D.C.: 500
Voltage: 85 reference
Secondary Gas — Hydrogen: 15 Std. Cubic Feet/hr. (SCFH)
Primary Gas — Nitrogen: 75 (SCFH)
Carrier Gas — Nitrogen: 37 (SCFH)
Rate of Vertical Feed: 24–32 inches/minute
Speed of Arbor Rotation: 60–90 rpm based on 4 inches diam. arbor
Powder Feed Rate: 6–8 lbs./hr.

Inasmuch as excessive temperatures will damage piston rings, during spraying, the temperature of the rings on the arbor (mandrel) is mantained below 700° F. and preferably below 400° F. It is not necessary to provide any subsequent heat treatment for the plasma jet coated rings other than allowing the rings to air cool to room temperature.

As indicated above, the metal fluorides of the present invention are the alkaline earth metal fluorides per se, or mixtures of such alkaline earth metal fluorides. Thus, alkaline earth metal fluorides which may be used in accordance with the present invention include calcium fluoride (the preferred material) magnesium fluoride, barium fluoride, and strontium fluoride. Also, mixtures of such fluorides may be used for example a 50/50 mixture of calcium fluoride and magnesium fluoride; calcium fluoride-barium fluoride mixtures, e.g., a 38% calcium fluoride-62% barium fluoride eutectic mixture.

The fluorides are conveniently powdered so as to have a particle size such that 98% will pass through a 100 mesh screen. For example, with calcium fluoride, a desired particle size distribution is such that a minimum of 98% of the calcium fluoride shall pass through a 120 mesh screen. The titanium dioxide-aluminum oxide composite desirably has a particle size distribution such that 98% of the oxide composite will pass through a 200 mesh screen and preferably a 270 mesh screen. With the mixed fluorides, it is desirable to fuse the fluorides together and then pulverize the solidified composite to a fineness whereby at least about 98% of the fluoride passes through a 120 mesh screen. The screen sizes herein are U.S. standard sleeve series.

The blending of the metal fluoride powder with the titanium dioxide/aluminum oxide may be simply a physical mixing of the components to obtain as uniform a distribution of the metal fluoride in the refractory metal oxide composite as possible prior to the plasma application thereof.

Alternately, the $TiO_2/Al_2O_3$ may be formed into a composite powder by a technique well known in the art and utilizing an organic binder, e.g. a phenolic varnish binder, (10% solids). Reference may be had to U.S. Pat. No. 3,991,240 for the method of forming a composite powder as distinct from a physical blend. In the following examples, where organic solids are referred to, any of the organic binders such as alkyd varnishes, tung oil, linseed oil, rubber, latex, etc. binders may be used. This technique aids in uniformity of distribution of the ingredients in the powder. The organic moiety of the composition is destroyed by the plasma spray temperatures.

The powders are applied to the rings on a mandrel or arbor 35 as taught in U.S. Pat. No. 3,697,091 and then allowed to cool to room temperature. While still on the mandrel, they are ground with an on-center plunge fed silicon carbide grinding wheel as exemplified below.

Typical examples of powders containing from 8.5 to 22.5% $TiO_2$, 76.5 to 67.5% $Al_2O_3$ and 10 to 15% by weight of alkaline earth metal fluoride, and which may be applied by the plasma spray technique using the foregoing spray parameters are as follows:

EXAMPLE I

Refractory Metal Oxide 90% By Total Weight
Titanium Dioxide . . . 12%
Aluminum Oxide . . . 88%
Metal Fluoride 10% By Total Weight
Calcium Fluoride . . . 100%

EXAMPLE II

Refractory Metal Oxide 87.5% By Total Weight
Titanium Dioxide . . . 13.5%
Organic Solids . . . 3.0% maximum
Aluminum Oxide . . . 78.0% minimum
Other Oxides Total . . . 5.5% maximum
Metal Fluoride 12.5% Total Weight
Calcium Fluoride . . . 100%

EXAMPLE III

Refractory Metal Oxide 85% By Total Weight
Titanium Dioxide . . . 13.5%
Organic Solids . . . 3.0% maximum
Aluminum Oxide . . . 78.0% minimum
Other Oxides Total . . . 5.5% maximum
Metal Fluoride 15% By Total Weight
Calcium Fluoride . . . 32%
Barium Fluoride . . . 68%

EXAMPLE IV

Refractory Metal Oxide 90% By Total Weight
Titanium Dioxide . . . 17%
Aluminum Oxide . . . 83%
Metal Fluoride 10% Total Weight
Calcium Fluoride . . . 100%

EXAMPLE V

Refractory Metal Oxide 90% By Total Weight
Titanium Dioxide . . . 17%
Aluminum Oxide . . . 83%
Metal Fluoride 10% Total Weight
Magnesium Fluoride . . . 100%

EXAMPLE VI

Refractory Metal Oxide 90% By Total Weight
Zirconium Oxide . . . 100%

Metal Fluoride 10% By Total Weight
Calcium Fluoride . . . 100%

A typical plasma spray powder of either the blended or composite type has the following formulation:

85 to 90% by weight of a first powder moiety which analyzes:

Titanium Dioxide (titania) . . . 12.0% to 15.0%
Aluminum Oxide (alumina) . . . 78.0% minimum
Other Metal Oxides . . . 0.0% to 5.5% maximum
Organic Binder Solids . . . 0.0% to 3.0% maximum 10 to 15% by weight of a second powder moiety which analyzes:

Calcium Fluoride . . . 100%

In the blended type of powder composition, no organic binder is employed. In the composite type, a dilute solution of the organic binder, e.g., phenolic resin binder, in a volatile solvent, e.g. methyl ethyl ketone, or the like is used. The solvent is removed on drying the powder which is then ready for spray application. The powder particle size is as stated above.

From the foregoing examples, it will be seen that the titanium dioxide, the alumium oxide and the metal fluoride constitute at least 91.5% of the total powder applied by plasma spray techinque.

The metal oxide moieties of the foregoing examples may contain other extraneous materials, for example, polyvalent metal oxides, e.g., $SiO_2$, MgO, BaO, CaO, $HfO_2$, ZrO, $Cr_2O_3$, etc. in minor amounts generally not above 8.5% by weight and preferably not to exceed 5.5% of the total powder. By the term "extraneous material" as used herein is meant a material whose presence in a minor amount does not adversely effect the manner in which the principal ingredient operates. These oxides frequently occur with the principal oxides and in the amounts stated are not detrimental. The powders may contain up to 8.5% of organic binder solids, preferably not to exceed 3% of the total powder.

The named ingredients and %'s in the foregoing examples are not intended to denote purity. 100% $CaF_2$, for example, signifies $CaF_2$ of commercially available purity including normally present impurities. Clearly, the pure ingredients may be used, if desired, and if available. Minerals, e.g., fluorite or fluorspar, are contemplated as suitable materials.

As indicated by Example VI zirconium oxide may be used as the entire metal oxide moiety, or it may be used to replace part or all of the titanium dioxide in the compositions, or it may be present as an extraneous material.

The foregoing compositions when plasma applied to a cast iron piston ring substrate greatly reduce the amount of wear on a silicon carbide grinding wheel by reason of in-cycle dressing. In the case of the preferred Example II with calcium fluoride as the additive agent to the plasma spray powder composition, the in-cycle dressing of the silicon carbide grinding wheel has been reduced from five dressings to zero dressings in the removal of about ½ of a 0.025 thick coating.

Piston rings so coated and ground when tested in an accelerated wear test in an engine showed very little decrease in wear properties over the wear properties obtained with refractory metal oxide coated piston rings (titanium dioxide/aluminum oxide composition).

The grinding wheel specifications and grinding parameters on rings coated with the plasma applied composition of Example II above are as follows:

TABLE I (a) Wheel - Bay State IC-802-J8-V32 30 inches × 5 inches × 12 inches
(b) Speed of Rotation = 1500 RPM
(c) Coarse Feed Rate = 0.075 inch/min.
(d) Fine Feed Rate = 0.002 inch/min.
(e) Start of Fine Feed = 0.006 inch diam. before final diam.
(f) Start of Dwell (or Tarry) = 0.003 inch diam. before final diam.
(g) Speed of Arbor Rotation = 225–275 RPM These are typical parameters for coatings of the type exemplified above. In general, the speed of rotation of the wheel may be from about 1000 to 2000 rpm with a coarse feed rate of 0.01 to 0.035 inch per minute, and a fine feed rate of 0.001 to 0.005 inch per minute. The speed of rotation of the arbor containing the group of piston rings on the mandrel is from 200 to 300 rpm for best results. A standard water base coolant is used during grinding.

Other examples of commercially available silicon carbide wheels useful in center-type cylindrical grinding piston rings coated with the fluoride modified refractory metal oxide coatings hereof are Norton 74C-80-I-8-VK, and the Carborundum Co. GC-100-GS-VGC. These are vitrified wheels having a hardness of "I" or "G" and grit sizes of 80 or 100 respectively. Generally, the silicon carbide wheels benefitted in accordance herewith are of the fine or very fine grain size, 70–500. Vitrified bond wheels are normally used in piston ring grinding although silicate or "water glass" bonded wheels may be used. Usually, the grades or hardnesses vary from G to V, i.e., in the medium to hard range.

Although Table I gives specific parameters, which have been found particulary suitable in production runs with titania-alumina coatings modified in accordance herewith on cast iron piston rings, it will be understood that variations therefrom may be made without departing from the invention. Whether or not in-cycle dressing is required even with the present modifications will depend on such matters as feed rate, for example; and if one exceeds prudent use of the wheel vis-a-vis the surface to be ground, in-cycle dressing can still become necessary. However, with a given set of grinding conditions, it will be found that in-cycle dressing will be reduced over what would otherwise be required without the modifications of this invention.

There has therefore been provided an improved process for increasing the life of silicon carbide grinding wheels when operating against a coating of mixed oxides of titanium and aluminum which have been plasma spray applied to a cast iron substrate. Basically, the method contemplates the addition to the plasma spary powder of a minor amount of a metal fluoride, particularly an alkaline earth metal fluoride or a mixture of alkaline earth metal fluorides and then grinding. Experience has shown that in-cycle dressing of the grinding wheel which is necessary in the absence of the metal fluoride, can be reduced substantially or entirely eliminated.

What is claimed is:

1. A method for increasing the life of silicon carbide grinding wheels used in manufacturing an article and which comprises forming a bearing surface on a metallic substrate by plasma spray applying a powder containing from 8.5 by weight to 22.5% by weight of titanium dioxide; from 76.5 by weight to 67.5% by weight of aluminum oxide, and from 10 to 15% by weight of a metal fluoride, said titanium dioxide, aluminum oxide and metal fluoride constituting at least 91.5% of said powder, said metal fluoride being selected from the group consisting of alkaline earth metal fluorides and mixtures of alkaline earth metal fluorides, cooling said coated metal substrate; and grinding said coating with a silicon carbide grinding wheel to smooth said surface, whereby the life of said silicon carbide grinding wheel is increased.

2. A method in accordance with claim 1 wherein up to about one-half the thickness of said coating is removed by grinding with said silicon carbide grinding wheel.

3. A method in accordance with claim 1 in which the metal fluoride is calcium fluoride.

4. A method in accordance with claim 1 in which the metal fluoride is a mixed $CaF_2/BaF_2$.

5. A method in accordance with claim 1 in which the plasma applied coating is formed from a powder having a first powder moiety-containing from 10 to 25% by weight of titanium dioxide, and from 90–75% aluminum oxide, said powder also containing a second powder moiety in an amount of from 10 to 15 parts per 100 parts of said first powder moiety of a metal fluoride selected from the group consisting of alkaline earth metal fluorides and mixtures of alkaline earth metal fluorides.

6. A method in accordance with claim 5 in which the powder mixture has the following composition:

85 to 90% by weight of said first powder moiety which analyzes:
Titanium Dioxide: 12.0 to 15.0%
Organic Binder Solids: 0.0 to 3.0% maximum
Aluminum Oxide: 78.0% minimum
Other Polyvalent Metal Oxides: 0.0 to 5.5%

10 to 15% by weight to a total of 100% by weight of said second powder moiety which analyzes:
Calcium Fluoride: 100%.

7. A method in accordance with claim 6 wherein the first powder moiety has a particle size such that 98% of it will pass through a 200 mesh screen, and the second powder moiety has a particle size such that 98% of it will pass through a 100 mesh screen.

8. A method in accordance with claim 6 wherein the first powder moiety has a particle size such that 98% of it will pass through a 270 mesh screen, and the second powder moiety has a particle size such that 98% of it will pass through a 120 mesh screen.

9. A method in accordance with claim 1 wherein the metallic substrate is cast iron.

10. A method in accordance with claim 1 wherein the article is a cast iron piston ring.

11. A method in accordance with claim 2 wherein the thickness of the plasma spray applied coating is from 0.020 to 0.030 inch.

12. A method in accordance with claim 1 wherein the powder is additionally characterized by the presence therein of up to 2.7% by weight of organic binder solids.

13. A method in accordance with claim 1 wherein the powder is additionally characterized by the presence therein of up to 4.95% by weight of other polyvalent metal oxides.

14. A method for increasing the life of silicon carbide grinding wheels used in manufacturing a cast iron piston ring adapted for use in a ring groove in a piston movable in a cylinder of an internal combustion engine and which comprises the steps of forming a refractory metal oxide bearing surface coating having a thickness of from 0.020 to 0.030 inch on the external periphery of said cast iron piston ring by plasma spray applying a powder having the following composition:

from 85 to 90 percent by weight of a first powder moiety which analyzes:
Titanium Dioxide: 12 to 15%
Organic Binder Solids: 0.0 to 3% maximum
Aluminum Oxide: 78.0% minimum
Other Polyvalent Metal Oxides: 0.0 to 5.5% from 10 to 15% by weight of a second powder moiety which analyzes:
Calcium Fluoride: 100% said first powder moiety having a particle size such that 98% of the powder passes through a 270 mesh screen, and said second powder moiety has a particle size such that 98% of it will pass through a 120 mesh screen; cooling said plasma coated piston ring in air; and removing about one half the thickness of the coating by grinding with a silicon carbide grinding wheel to smooth and finish said bearing surface, whereby the life of said silicon carbide grinding wheel is increased.

15. A method for increasing the life of silicon carbide grinding wheels when operating against a plasma applied bearing surface coating of mixed oxides of titanium and aluminum from a powder mixture of said oxides on a cast iron substrate which comprises the steps of incorporating from 10 to 15% by weight of a metal fluoride into the powder prior to the plasma application to said substrate, said metal fluoride being selected from the group consisting of alkaline earth metal fluorides, and mixtures of alkaline earth metal fluorides, and grinding off up to about one-half the thickness of said coating with said silicon carbide grinding wheel to smooth and finish said piston ring.

* * * * *